US007036288B2

(12) United States Patent
Vetter et al.

(10) Patent No.: US 7,036,288 B2
(45) Date of Patent: May 2, 2006

(54) SYSTEM FOR MONITORING PRODUCTION OF PREFILLED SYRINGES

(75) Inventors: Udo J. Vetter, Ravensburg (DE); Helmut Hennig, Warthausen (DE)

(73) Assignee: Arzneimittel GmbH Apotheker Vetter & Co. Ravensburg, Ravensburg (DE)

( * ) Notice: Subject to any disclaimer, the term of this patent is extended or adjusted under 35 U.S.C. 154(b) by 0 days.

(21) Appl. No.: 10/779,527

(22) Filed: Feb. 12, 2004

(65) Prior Publication Data

US 2004/0182475 A1 Sep. 23, 2004

(30) Foreign Application Priority Data

Feb. 15, 2003 (DE) ..... 103 06 400

(51) Int. Cl.
*B65B 57/02* (2006.01)

(52) U.S. Cl. ..... 53/53; 53/52; 53/493

(58) Field of Classification Search ..... 53/52, 53/493; 141/94, 98, 130
See application file for complete search history.

(56) References Cited

U.S. PATENT DOCUMENTS 4,978,335 A * 12/1990 Arthur, III ..... 604/67
5,390,469 A * 2/1995 Shimizu et al. ..... 53/53
5,597,530 A * 1/1997 Smith et al. ..... 422/28
5,597,995 A * 1/1997 Williams et al. ..... 235/375
5,651,775 A * 7/1997 Walker et al. ..... 604/207
5,801,356 A * 9/1998 Richman ..... 219/121.68
5,884,457 A * 3/1999 Ortiz et al. ..... 53/468
5,919,553 A * 7/1999 Kavanaugh ..... 428/195.1
6,189,292 B1 * 2/2001 Odell et al. ..... 53/425
6,255,614 B1 * 7/2001 Yamakawa et al. ..... 209/587
6,317,648 B1 * 11/2001 Sleep et al. ..... 700/216
6,499,270 B1 * 12/2002 Peroni et al. ..... 53/53
6,597,969 B1 * 7/2003 Greenwald et al. ..... 700/216
6,685,678 B1 * 2/2004 Evans et al. ..... 604/207
6,722,404 B1 * 4/2004 Osborne ..... 141/133
6,769,228 B1 * 8/2004 Mahar ..... 53/411
6,813,868 B1 * 11/2004 Baldwin et al. ..... 53/411

* cited by examiner

*Primary Examiner*—Stephen F. Gerrity
*Assistant Examiner*—Hemant M. Desai
(74) *Attorney, Agent, or Firm*—Andrew Wilford

(57) ABSTRACT

Prefilled syringes are made by displacing a succession of syringes along a conveyor path from a supply station successively through a marking station, a filling station, and to a downstream packing station. Each of the syringes is filled with a predetermined dose of a medicament in the filling station. The syringes are marked in the marking station with machine-readable data identifying the medicament to be put in the empty syringe at the filling station. The syringes are scanned downstream of the marking station and any syringe whose data is not readable is then removed from the conveyor path, as is any syringe whose data does not correspond to the medicament filled into the syringe at the filling station.

13 Claims, 2 Drawing Sheets

SYSTEM FOR MONITORING PRODUCTION OF PREFILLED SYRINGES

FIELD OF THE INVENTION

The present invention relates to the production of hypodermic syringes. More particularly this invention concerns the production of prefilled ready-to-use syringes.

BACKGROUND OF THE INVENTION

A prefilled syringe is normally made by first sterilizing and drying the open syringe body. Then it is filled with the required medicament and capped. At the end of the process the filled and capped syringe is packaged.

The syringes are normally labeled so that the user can determine that he or she has the right product. Clearly it is critical that the contents match the label, as otherwise serious accidents could occur. In fact the label typically not only identifies the medicament and dose size, but also the production date and the expiration date. Other information such as price, producer's code, and batch number can also be printed on the syringe or on a label attached to it.

The labeling serves primarily for the user to determine that the right medicament is being or has been administered. It is often difficult or impossible to read and serves little function during the actual production of the syringe.

SUMMARY OF THE INVENTION

Prefilled syringes are made according to the invention by displacing a succession of syringes along a conveyor path from a supply station successively through a marking station, a filling station, and to a downstream packing station. Each of the syringes is filled with a predetermined dose of a medicament in the filling station. The syringes are marked in the marking station with machine-readable data identifying the medicament to be put in the empty syringe at the filling station. The syringes are scanned downstream of the marking station and any syringe whose data is not readable is then removed from the conveyor path, as is any syringe whose data does not correspond to the medicament filled into the syringe at the filling station.

Thus according to the invention this data is provided before the syringes are filled. It may be applied even before they are cleaned and sterilized, or after this step. Either way the production equipment gains according to the instant invention the ability to check all along the production path whether the right medicament is going into the right syringe. Going further, it is possible to use a machine scan to ensure that the right syringes are being used for each patient, and even to confirm after administration whether the right syringe was used.

The machine-readable data marked on the syringes is redundant, that is it can be applied in standard written-out form readable by the user, and in an encoded format, for instance a bar code, particularly readable by a scanner. Two versions of the data can be printed on the syringe so that minor cosmetic damage to the syringe will not make it unreadable, something that is particularly important to prevent waste of valuable medical supplies. The markings can be encoded by the Data Matrix ECC 200 standard.

In accordance with the invention the syringes are marked before any production steps, that is as they are pulled from the supply of empty syringes. Thus the cleaning/filling/packaging machinery can monitor the syringes through the entire production process. Thus according to the invention the syringes are scanned at several locations along the path.

The markings applied to the syringes can be put in an ink that is not readable under normal light. Thus the scanner can employ ultraviolet or black light to read the markings. Normally they are printed on the syringes, although it is within the scope of the invention for the markings to be laser-inscribed on the syringes, a procedure ensuring that they will remain readable under the worst of conditions.

In according to with the invention the syringes are rotated about their axis during scanning of the markings. This scanning can be done from two locations offset angularly with respect to the axis of the syringe is scanned and the syringes are rotated at an angular speed coordinated with a frame rate of a scanning device effecting the scanning. This ensures that even if the syringes-have gotten turned around-on the conveyor, they will be read and will not be unnecessarily culled out.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
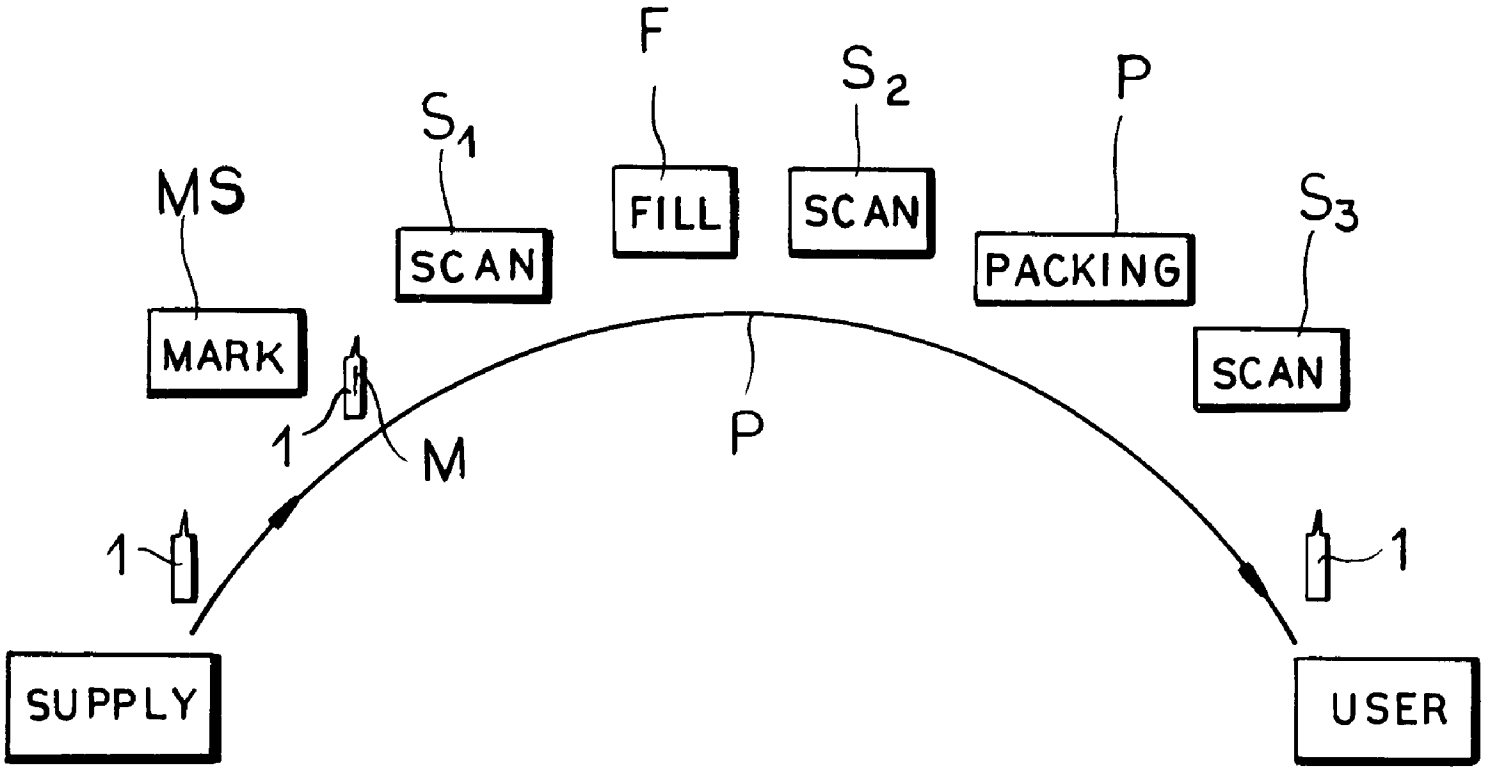
FIG. 1 is a schematic diagram illustrating the method of this invention.

As seen in FIG. 1 a succession of syringes 1 come from a supply and pass on a conveyor path through a marking station M where they are printed or laser-inscribed with markings M of data regarding the composition of the medicament to be filled later into them, the production date, the expiration date, the dosage, and the like. The information is written out and encoded, and some information may be marked in ink only readable under UV light.

Then the syringes 1 move on the path P through a scanning station S1 where any syringes 1 whose markings cannot be read are culled out. They are then filled in a filling station F, and then scanned again in a station S2 to make sure that the indicia on the syringes 1 corresponds to what was just filled into them in the station F. The syringes 1 are then put in boxes in a packing station P and the packed syringes 1 are scanned again in a station S3 to ensure that what is packed corresponds to what is supposed to be in the box. Finally they are supplied to a user. Further scanning at the end-user location can be used to confirm that what is being administered and what has been administered is the right medicament.

Of course it is possible to have a cleaning station upstream of the first marking station M and a capping station between the filling station F and packing station P. What is critical is that the indicia or markings M be applied early in the production cycle and used to match the syringes with the products they are to be filled with and the packages they are to be packed into.

Figure 2:
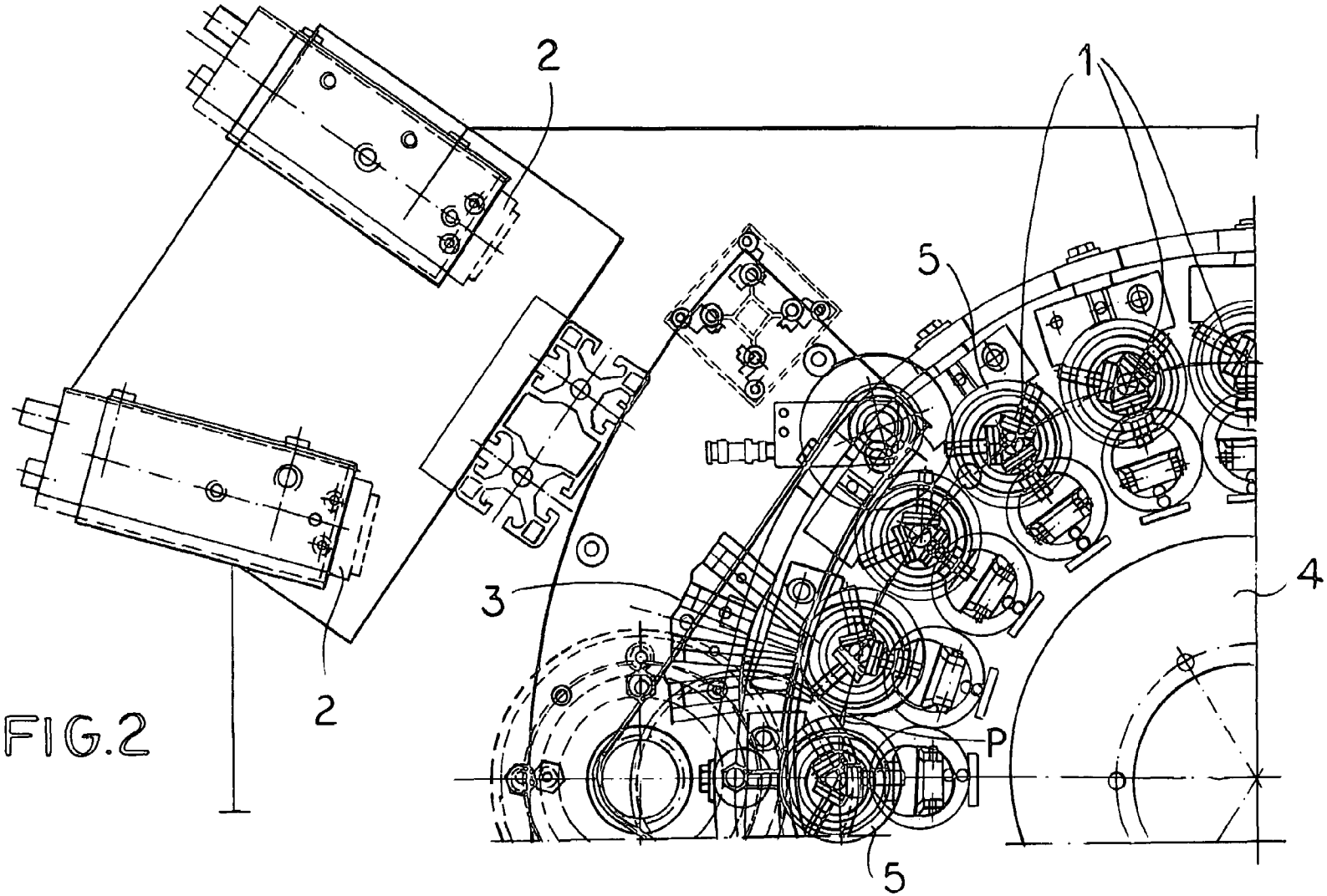
FIG. 2 is a view of a detail of a machine for carrying out the method.

FIG. 2 shows the syringes carried on a carousel or turntable-type conveyor 4 for movement along an arcuate path P. The syringes 1 are in holders 5 that can rotate them about their upright center axes as they pass a pair of optical scanners 2 that are angularly offset from each other. The rotation of the syringes 1 is synchronized with the frame rate of the scanners 2 so that at least one of the two scanners 2 will be certain to get a good read of the markings M as they pass. Any syringes 1 found to be unreadable or to have markings M that do not correspond with what a central controller knows they are supposed to hold are culled out by an extracting device 3.

We claim:

1. A method of making prefilled syringes, the method comprising the steps of:

displacing a succession of syringes along a conveyor path from a supply station successively through a marking station, a filling station, and to a downstream packing station;

permanently marking the syringes in the marking station with machine-readable data identifying the medicament to be put in the empty syringe at the filling station;

scanning the syringes downstream of the marking station and upstream of the filling station and removing from the conveyor path any syringe whose data is not readable;

filling each of the syringes with a predetermined dose of a medicament in the filling station; and scanning the syringes downstream of the filling station and upstream of the packing station and removing from the conveyor path any syringe whose data does not correspond to the medicament filled into the syringe at the filling station.

2. The method of making prefilled syringes defined in claim 1 wherein the machine-readable data marked on the syringes is redundant.

3. The method of making prefilled syringes defined in claim 1 wherein the markings are not readable under normal light.

4. The method of making prefilled syringes defined in claim 1 wherein the markings are printed on the syringes.

5. The method of making prefilled syringes defined in claim 1 wherein the markings are laser-inscribed on the syringes.

6. The method of making prefilled syringes defined in claim 1, further comprising the step of rotating the syringes about their axes during scanning of the markings.

7. The method of making prefilled syringes defined in claim 6 wherein the scanning is effected from two locations offset angularly with respect to the axis of the syringe being scanned.

8. The method of making prefilled syringes defined in claim 6 wherein the syringes are rotated at an angular speed coordinated with a frame rate of a scanning device effecting the scanning.

9. The method defined in claim 1, further comprising the steps of:

loading the syringes into respective packages carrying contents identification at the packing station; and scanning the syringes downstream of the packing station and removing from the conveyor path any package whose syringe's data does not correspond to the medicament identified on the respective package.

10. An apparatus for making prefilled syringes, the apparatus comprising:

means for displacing a succession of syringes along a conveyor path from a supply station successively through a marking station, a filling station, and to a downstream packing station;

means at the filling station for filling each of the syringes with a predetermined dose of a medicament in the filling station;

means along the path at the marking station upstream of the filling station for permanently marking the syringes with machine-readable data identifying the medicament to be put in the empty syringe at the filling station;

means along the path downstream of the marking station and upstream of the filling station for scanning the syringes and removing from the conveyor path any syringe whose data is not readable; and means along the path downstream of the filling station and upstream of the packing station for removing from the conveyor path any syringe whose data does not correspond to the medicament filled into the syringe at the filling station.

11. The apparatus defined in claim 10 wherein the means for scanning includes means for rotating the syringe about their axes.

12. The apparatus defined in claim 10 wherein the scanning means is formed as a separate removable module.

13. The apparatus defined in claim 10, further comprising:

means for loading the syringes into respective packages carrying contents identification at the packing station; and means downstream of the packing station for scanning the syringes and removing from the conveyor path any package whose syringe's data does not correspond to the medicament identified on the respective package.

* * * * *